US010435807B2

(12) United States Patent
Feng et al.

(10) Patent No.: US 10,435,807 B2
(45) **Date of Patent: *Oct. 8, 2019**

(54) LIPSEALS AND CONTACT ELEMENTS FOR SEMICONDUCTOR ELECTROPLATING APPARATUSES

(71) Applicant: Novellus Systems, Inc., Fremont, CA (US)

(72) Inventors: Jingbin Feng, Lake Oswego, OR (US); Robert M. Stowell, Wilsonville, OR (US); Frederick D. Wilmot, Gladstone, OR (US)

(73) Assignee: Novellus Systems, Inc., Fremont, CA (US)

( * ) Notice: Subject to any disclaimer, the term of this patent is extended or adjusted under 35 U.S.C. 154(b) by 128 days.

This patent is subject to a terminal disclaimer.

(21) Appl. No.: 14/957,156

(22) Filed: Dec. 2, 2015

(65) Prior Publication Data

US 2016/0186355 A1 Jun. 30, 2016

Related U.S. Application Data

(62) Division of application No. 13/584,343, filed on Aug. 13, 2012, now Pat. No. 9,228,270.

(Continued)

(51) Int. Cl.
*C25D 17/06* (2006.01)
*C25D 17/00* (2006.01)

(Continued)

(52) U.S. Cl.
CPC ..... *C25D 17/005* (2013.01); *C25D 7/123* (2013.01); *C25D 17/001* (2013.01);

(Continued)

(58) Field of Classification Search
CPC ..... C25D 7/12–7/123; C25D 17/00; C25D 17/011; C25D 17/004; C25D 17/005; C25D 17/007; C25D 17/06

(Continued)

(56) References Cited

U.S. PATENT DOCUMENTS 2,773,257 A 12/1956 Craggs et al.
3,225,899 A 12/1965 Lo Presti et al.

(Continued)

FOREIGN PATENT DOCUMENTS

CN 1509348 A 6/2004
CN 1550033 A 11/2004

(Continued)

OTHER PUBLICATIONS

Integrate, Merriam-Webster, https://www.merriam-webster.com/dictionary/integrate).*

(Continued)

*Primary Examiner* — Alexander W Keeling
(74) *Attorney, Agent, or Firm* — Weaver Austin Villeneuve & Sampson LLP

(57) ABSTRACT

Disclosed herein are lipseal assemblies for use in electroplating clamshells which may include an elastomeric lipseal for excluding plating solution from a peripheral region of a semiconductor substrate and one or more electrical contact elements. The contact elements may be structurally integrated with the elastomeric lipseal. The lipseal assemblies may include one or more flexible contact elements at least a portion of which may be conformally positioned on an upper surface of the elastomeric lipseal, and may be configured to flex and form a conformal contact surface that interfaces with the substrate. Some elastomeric lipseals disclosed herein may support, align, and seal a substrate in a clamshell, and may include a flexible elastomeric upper portion (Continued)

located above a flexible elastomeric support edge, the upper portion having a top surface and an inner side surface, the later configured to move inward and align the substrate upon compression of the top surface.

7 Claims, 6 Drawing Sheets

Related U.S. Application Data

(60) Provisional application No. 61/523,800, filed on Aug. 15, 2011.

(51) Int. Cl.
*C25D 7/12* (2006.01)
*C25D 17/08* (2006.01)

(52) U.S. Cl.
CPC ..... *C25D 17/004* (2013.01); *C25D 17/007* (2013.01); *C25D 17/06* (2013.01); *C25D 17/08* (2013.01); *Y10T 29/49778* (2015.01)

(58) Field of Classification Search
USPC ..... 414/935–941
See application file for complete search history.

(56) References Cited

U.S. PATENT DOCUMENTS 3,430,055 A 2/1969 Metzger
3,684,633 A 8/1972 Haase
3,716,765 A 2/1973 Rueffer et al.
3,724,471 A 4/1973 Sitges
4,418,432 A 12/1983 Vidal
4,466,864 A 8/1984 Bacon et al.
4,569,695 A 2/1986 Yamashita et al.
4,654,235 A 3/1987 Effenberger et al.
4,924,891 A 5/1990 Soubrier et al.
5,000,827 A 3/1991 Schuster et al.
5,221,449 A 6/1993 Colgan et al.
5,227,041 A 7/1993 Brogden et al.
5,281,485 A 1/1994 Colgan et al.
5,289,639 A 3/1994 Bard et al.
5,311,634 A 5/1994 Andros
5,482,611 A 1/1996 Helmer et al.
5,519,945 A 5/1996 Ahvenniemi et al.
5,723,028 A 3/1998 Poris
5,853,559 A 12/1998 Tamaki et al.
5,860,361 A 1/1999 Nanjyo et al.
5,985,762 A 11/1999 Geffken et al.
6,071,388 A 6/2000 Uzoh
6,074,544 A 6/2000 Reid et al.
6,080,291 A 6/2000 Woodruff et al.
6,099,702 A 8/2000 Reid et al.
6,108,847 A 8/2000 Cueman et al.
6,110,346 A 8/2000 Reid et al.
6,124,203 A 9/2000 Joo et al.
6,126,798 A 10/2000 Reid et al.
6,139,712 A 10/2000 Patton et al.
6,156,167 A 12/2000 Patton et al.
6,159,354 A 12/2000 Contolini et al.
6,162,344 A 12/2000 Reid et al.
6,176,985 B1 1/2001 Downes, Jr. et al.
6,179,973 B1 1/2001 Lai et al.
6,179,983 B1 1/2001 Reid et al.
6,193,854 B1 2/2001 Lai et al.
6,217,716 B1 4/2001 Lai
6,221,757 B1 4/2001 Schmidbauer et al.
6,251,238 B1 6/2001 Kaufinan et al.
6,251,242 B1 6/2001 Fu et al.
6,261,433 B1 7/2001 Landau
6,267,860 B1 7/2001 Brodsky
6,270,646 B1 8/2001 Walton et al.
6,274,008 B1 8/2001 Gopalraja et al.
6,277,249 B1 8/2001 Gopalraja et al.
6,303,010 B1 10/2001 Woodruff et al.
6,309,520 B1 10/2001 Woodruff et al.
6,309,981 B1 10/2001 Mayer et al.
6,379,468 B1 4/2002 Chang et al.
RE37,749 E 6/2002 Poris
6,398,926 B1 6/2002 Mahneke
6,413,388 B1 7/2002 Uzoh et al.
6,436,249 B1 8/2002 Patton et al.
6,517,689 B1 2/2003 Hongo et al.
6,540,899 B2 4/2003 Keigler
6,551,487 B1 4/2003 Reid et al.
6,579,430 B2 6/2003 Davis et al.
6,589,401 B1 7/2003 Patton et al.
6,612,915 B1 9/2003 Uzoh et al.
6,613,214 B2 9/2003 Dordi et al.
6,627,052 B2 9/2003 Fluegel et al.
6,755,946 B1 * 6/2004 Patton ..... C25D 17/06 204/224 R
6,755,954 B2 6/2004 Mayer et al.
6,773,560 B2 8/2004 Pedersen et al.
6,800,187 B1 10/2004 Reid et al.
6,869,510 B2 3/2005 Woodruff et al.
6,908,540 B2 6/2005 Kholodenko
7,033,465 B1 4/2006 Patton et al.
7,070,686 B2 * 7/2006 Contolini ..... C25D 17/008 204/212
7,087,144 B2 8/2006 Herchen
7,285,195 B2 10/2007 Herchen et al.
7,522,055 B2 4/2009 Carrender et al.
7,935,231 B2 5/2011 Ghongadi et al.
7,985,325 B2 7/2011 Rash et al.
8,172,992 B2 5/2012 Prabhakar et al.
8,377,268 B2 2/2013 Rash et al.
8,398,831 B2 3/2013 Ghongadi et al.
9,221,081 B1 12/2015 Mayer et al.
9,228,270 B2 * 1/2016 Feng ..... C25D 17/06
9,476,139 B2 10/2016 Chua et al.
9,746,427 B2 8/2017 Mayer et al.
9,988,734 B2 * 6/2018 Feng ..... C25D 17/06
10,053,793 B2 8/2018 Berke et al.
10,066,311 B2 * 9/2018 Ostrowski ..... C25D 17/004
2001/0020480 A1 9/2001 Yoshikawa et al.
2002/0000372 A1 1/2002 Pedersen et al.
2002/0020763 A1 2/2002 Hirae et al.
2002/0084183 A1 7/2002 Hanson et al.
2002/0108851 A1 8/2002 Woodruff et al.
2002/0134403 A1 9/2002 Selwyn et al.
2002/0144900 A1 * 10/2002 Keigler ..... C25D 17/06 204/297.05
2002/0153260 A1 10/2002 Egli et al.
2002/0157686 A1 10/2002 Kenny et al.
2003/0010641 A1 1/2003 Kholodenko
2003/0085118 A1 5/2003 Tench et al.
2003/0085119 A1 5/2003 Davis et al.
2003/0134044 A1 7/2003 Aoki et al.
2003/0181349 A1 9/2003 Maeno et al.
2003/0201184 A1 10/2003 Dordi et al.
2004/0002430 A1 1/2004 Verhaverbeke
2004/0060576 A1 4/2004 Cronin et al.
2004/0084301 A1 5/2004 Dordi et al.
2004/0112405 A1 6/2004 Lee et al.
2004/0149573 A1 8/2004 Herchen
2004/0171277 A1 9/2004 Oh et al.
2005/0014368 A1 1/2005 Yoshioka et al.
2005/0081899 A1 4/2005 Shannon
2005/0183947 A1 8/2005 Henuset
2005/0218000 A1 10/2005 Hafezi et al.
2005/0284754 A1 12/2005 Herchen et al.
2005/0287928 A1 12/2005 Hardikar et al.
2006/0118132 A1 6/2006 Bergman et al.
2006/0151007 A1 7/2006 Bergman
2006/0226000 A1 10/2006 Hanson et al.
2006/0237308 A1 10/2006 Herchen
2006/0246690 A1 11/2006 Dordi et al.
2006/0266653 A1 11/2006 Birang et al.
2007/0077871 A1 4/2007 Park et al.
2007/0141849 A1 6/2007 Kanno et al.
2007/0199578 A1 8/2007 Nomura et al.

(56) References Cited

U.S. PATENT DOCUMENTS

| | | | | |
|---|---|---|---|---|
| 2008/0011322 | A1 | 1/2008 | Weber et al. | |
| 2008/0117051 | A1 | 5/2008 | Carrender et al. | |
| 2009/0009753 | A1 | 1/2009 | Horai et al. | |
| 2009/0033889 | A1 | 2/2009 | Bleeker et al. | |
| 2009/0107835 | A1 | 4/2009 | Ghongadi et al. | |
| 2009/0107836 | A1* | 4/2009 | Rash | C25D 17/02 204/297.01 |
| 2009/0117730 | A1 | 5/2009 | Maitani et al. | |
| 2010/0116290 | A1 | 5/2010 | Zhu et al. | |
| 2010/0144158 | A1 | 6/2010 | Ito et al. | |
| 2010/0155254 | A1 | 6/2010 | Prabhakar et al. | |
| 2010/0216302 | A1 | 8/2010 | Luo et al. | |
| 2011/0181000 | A1 | 7/2011 | Ghongadi et al. | |
| 2011/0233056 | A1 | 9/2011 | Rash et al. | |
| 2012/0043200 | A1 | 2/2012 | Fujikata et al. | |
| 2012/0137970 | A1 | 6/2012 | Naruse et al. | |
| 2012/0181170 | A1 | 7/2012 | Prabhakar et al. | |
| 2013/0042454 | A1 | 2/2013 | Feng et al. | |
| 2013/0062197 | A1 | 3/2013 | He et al. | |
| 2013/0256146 | A1 | 10/2013 | Chua et al. | |
| 2013/0292254 | A1 | 11/2013 | Kumar et al. | |
| 2014/0230855 | A1 | 8/2014 | Mayer et al. | |
| 2014/0367265 | A1 | 12/2014 | Ravid et al. | |
| 2015/0218726 | A1 | 8/2015 | Feng et al. | |
| 2016/0145761 | A1 | 5/2016 | Mayer et al. | |
| 2016/0201212 | A1 | 7/2016 | Ostrowski et al. | |
| 2017/0009369 | A1 | 1/2017 | Berke et al. | |
| 2017/0009370 | A1 | 1/2017 | Chua et al. | |
| 2017/0073832 | A1 | 3/2017 | Berke et al. | |
| 2017/0299524 | A1 | 10/2017 | Arora et al. | |
| 2018/0347065 | A1 | 12/2018 | Feng et al. | |
| 2018/0363162 | A1 | 12/2018 | Ostrowski et al. | |
| 2019/0040544 | A1 | 2/2019 | Berke et al. | |

FOREIGN PATENT DOCUMENTS

| | | | |
|---|---|---|---|
| CN | 1623012 | A | 6/2005 |
| CN | 1930666 | A | 3/2007 |
| CN | 100370578 | C | 2/2008 |
| CN | 100469948 | C | 3/2009 |
| CN | 101425471 | A | 5/2009 |
| CN | 101599420 | | 12/2009 |
| CN | 101798698 | | 8/2010 |
| CN | 102953104 | A | 3/2013 |
| CN | 103031580 | A | 4/2013 |
| DE | 19859467 | A1 | 7/2000 |
| EP | 1 724 820 | A1 | 11/2006 |
| JP | 2002-069698 | | 3/2002 |
| JP | 2002-540011 | | 11/2002 |
| JP | 2004-83932 | | 3/2004 |
| JP | 2004-247738 | | 9/2004 |
| JP | 2004-270014 | | 9/2004 |
| JP | 2008-95157 | | 4/2008 |
| JP | 2010-150659 | | 7/2010 |
| KR | 10-2004-0019286 | A | 3/2004 |
| KR | 10-2004-0079843 | | 9/2004 |
| KR | 10-2004-0081577 | | 9/2004 |
| KR | 10-2005-0068038 | | 7/2005 |
| KR | 10-2008-0007931 | | 1/2008 |
| KR | 10-2010-0067072 | A | 6/2010 |
| TW | 531770 | | 5/2003 |
| TW | 544811 | | 8/2003 |
| TW | 200409836 | | 6/2004 |
| TW | 200410296 | A | 6/2004 |
| TW | 200511422 | A | 3/2005 |
| TW | I244548 | | 12/2005 |
| TW | 201500595 | A | 1/2015 |
| TW | 1585246 | B | 6/2017 |
| TW | I585246 | B | 6/2017 |
| WO | WO 99/041434 | | 8/1999 |
| WO | WO 03/006718 | | 1/2003 |
| WO | WO 03/010368 | A1 | 2/2003 |
| WO | WO 2013/148890 | | 10/2013 |

OTHER PUBLICATIONS

U.S. Appl. No. 14/936,328, titled "Integrated Elastomeric Lipseal and Cup Bottom for Reducing Wafer Sticking," filed Nov. 9, 2015.
U.S. Appl. No. 13/563,619, titled "Automated Cleaning of Wafer Plating Assembly," filed Jul. 31, 2012.
U.S. Office Action, dated Nov. 1, 2011, issued in U.S. Appl. No. 12/633,219.
U.S. Notice of Allowance, dated Jan. 12, 2012, issued in U.S. Appl. No. 12/633,219.
U.S. Notice of Allowance, dated Mar. 19, 2012, issued in U.S. Appl. No. 12/633,219.
U.S. Office Action, dated Oct. 26, 2012, issued in U.S. Appl. No. 13/432,767.
U.S. Final Office Action, dated Nov. 26, 2013, issued in U.S. Appl. No. 13/432,767.
U.S. Office Action, dated Nov. 6, 2014, issued in U.S. Appl. No. 13/563,619.
U.S. Final Office Action, dated Apr. 23, 2015, issued in U.S. Appl. No. 13/563,619.
U.S. Notice of Allowance, dated Aug. 31, 2015, issued in U.S. Appl. No. 13/563,619.
U.S. Notice of Allowance [corrected Notice of Allowability], dated Sep. 23, 2015, issued in U.S. Appl. No. 13/563,619.
U.S. Office Action, dated Feb. 23, 2015, issued in U.S. Appl. No. 13/584,343.
U.S. Notice of Allowance, dated Aug. 31, 2015, issued in U.S. Appl. No. 13/584,343.
U.S. Office Action, dated Mar. 2, 2011, issued in U.S. Appl. No. 11/929,638.
U.S. Notice of Allowance, dated May 23, 2011, issued in U.S. Appl. No. 11/929,638.
U.S. Office Action, dated Jul. 7, 2010, issued in U.S. Appl. No. 11/932,595.
U.S. Office Action, dated Nov. 17, 2010, issued in U.S. Appl. No. 11/932,595.
U.S. Notice of Allowance, dated Jan. 26, 2011, issued in U.S. Appl. No. 11/932,595.
U.S. Notice of Allowance, dated Mar. 8, 2011, issued in U.S. Appl. No. 11/932,595.
U.S. Notice of Allowance (Supplemental Notice of Allowability) dated Mar. 11, 2011, issued in U.S. Appl. No. 11/932,595.
U.S. Notice of Allowance, dated Mar. 18, 2011, issued in U.S. Appl. No. 11/932,595.
U.S. Office Action, dated Nov. 4, 2011, issued in U.S. Appl. No. 13/154,224.
U.S. Office Action, dated Mar. 16, 2012, issued in U.S. Appl. No. 13/154,224.
U.S. Final Office Action, dated Jul. 18, 2012, issued in U.S. Appl. No. 13/154,224.
U.S. Notice of Allowance, dated Oct. 4, 2012, issued in U.S. Appl. No. 13/154,224.
U.S. Notice of Allowance (Corrected Notice of Allowability) dated Jan. 23, 2013, issued in U.S. Appl. No. 13/154,224.
U.S. Office Action, dated May 21, 2012, issued in U.S. Appl. No. 13/079,745.
U.S. Office Action, dated Sep. 21, 2012, issued in U.S. Appl. No. 13/079,745.
U.S. Notice of Allowance, dated Nov. 19, 2012, issued in U.S. Appl. No. 13/079,745.
U.S. Office Action, dated Oct. 28, 2015, issued in U.S. Appl. No. 13/852,767.
Chinese First Office Action dated May 2, 2013 issued in CN 200910211989.X.
Japanese Office Action, dated Oct. 2, 2012, issued in Application No. 2009-278998.
Korean Description of Notification of Provisional Rejection, dated May 10, 2012, issued in Application No. 2009-0122738.
Korean Notification of Decision to Grant, dated Sep. 4, 2012, issued in Application No. 2009-0122738.
Singapore Search Report and Written Opinion, dated Mar. 9, 2011, issued in Application No. 200908245.4.

(56) References Cited

OTHER PUBLICATIONS

Singapore Search and Examination Report, dated Oct. 27, 2011, issued in Application No. 200908245.4.
Taiiwan International Search Report, dated Jun. 11, 2012, issued in Application No. 098142112.
Singapore Search Report and Written Opinion, dated Oct. 6, 2014, issued in Application No. 201206129-7.
Singapore Final Exam Report, dated May 20, 2015, issued in Application No. 201206129-7.
PCT International Search Report and Written Opinion dated Jul. 25, 2013 issued in PCT/US2013/034178.
PCT International Preliminary Report on Patentability and Written Opinion dated Oct. 9, 2014 issued in PCT/US2013/034178.
Everett, D.H. (2001) "Definition of Surface Active Agents," *Manual of Symbols and Terminology for Physicochemical Quantities and Units, Appendix II, International Union of Pure and Applied Chemistry, Division of Physical Chemistry,* Adopted by the IUPAC Council at Washington DC, USA on Jul. 23, 1971, 6pp.
Shin-Etsu Polymer Co., Ltd., "L-type connector," http://www.shinpoly.co.jp./business/connector/products_e/l/html?typezeb (one page) downloaded May 23, 2003.
Shin-Etsu Polymer Co., Ltd., "SS-type connector," http://www.shinpoly.co.jp./business/connector/products_e/ss.html?typezeb (2 pages) downloaded May 23, 2003.
Zheng, CN 101599420a, abstract and machine translation (2009).
U.S. Appl. No. 15/004,593, titled "Durable Low Cure Temperature Hydrophobic Coating in Electroplating Cup Asssembly," filed Jan. 22, 2016.
U.S. Notice of Allowance, dated Jun. 30, 2016, issued in U.S. Appl. No. 13/853,935.
U.S. Final Office Action, dated Apr. 28, 2016, issued in U.S. Appl. No. 13/852,767.
Chinese First Office Action dated Jan. 26, 2016, issued in Application No. CN 201210289735.1.
Japanese First Office Action dated Jun. 28, 2016, issued in Application No. JP 2012-179853.
Taiwan Office Action and Search Report, dated May 12, 2016, issued in Application No. TW 101129602.
Chinese First Office Action dated Mar. 2, 2016 issued in Application No. CN 201380023757.6.
Cambridge English Dictionary, Meaning of "against" (2016), 2 pages.
U.S. Office Action, dated Nov. 23, 2016, issued in U.S. Appl. No. 14/178,804.
U.S. Notice of Allowance, dated May 3, 2017, issued in U.S. Appl. No. 14/178,804.
U.S. Notice of Allowance [Corrected Notice of Allowability], dated Jul. 21, 2017, issued in U.S. Appl. No. 14/178,804.
U.S. Office Action, dated Mar. 6, 2017, issued in U.S. Appl. No. 14/685,526.
U.S. Notice of Allowance, dated Aug. 7, 2017, issued in U.S. Appl. No. 14/685,526.
U.S. Office Action, dated Sep. 21, 2017, issued in U.S. Appl. No. 14/990,725.
U.S. Notice of Allowance, dated Sep. 1, 2017, issued in U.S. Appl. No. 14/936,328.
U.S. Office Action, dated Oct. 31, 2017, issued in U.S. Appl. No. 15/004,593.
U.S. Office Action, dated Feb. 24, 2017, issued in U.S. Appl. No. 13/852,767.
U.S. Final Office Action, dated Aug. 25, 2017, issued in U.S. Appl. No. 13/852,767.
Chinese First Office Action dated Jun. 20, 2017 issued in CN 201510837221.9.
Chinese Second Office Action dated Nov. 2, 2016, issued in Application No. CN 201210289735.1.
Japanese Second Office Action dated Mar. 14, 2017, issued in Application No. JP 2012-179853.
Taiwan Office Action, dated Jul. 11, 2017, issued in Application No. TW 106105154.
Taiwan Notice of Allowance and Search Report, dated Sep. 8, 2017, issued in Application No. TW 102111465.
Chinese Second Office Action dated Jan. 24, 2017 issued in Application No. CN 201380023757.6.
Taiwan Examination and Search Report dated Oct. 12, 2016, issued in TW 102111233.
DuPont Teflon, Dupont, May 2015, 5pp [Downloaded on Oct. 11, 2017 at https://web.archive.org/web/20150301000000*https://plastics.ulprospector.com/generics/41/c/t/polyphenylene-sulfide-pps-properties-processing].
Guide to Whitford Industrial Coatings 2012, *Whitford Worldwide*, 3pp [Downloaded on Oct. 11, 2017 at https://web.archive.org/web/*/http://efpadam2.itum.com/files/files/rpn/7.pdf] (Year: 2012).
*Wikipedia, the free encyclopedia,* Definition of "Through hole" [Downloaded on Aug. 24, 2017 from https://en.wikipedia.org/wiki/Through_hole, 1 page.
U.S. Notice of Allowance, dated Feb. 6, 2018, issued in U.S. Appl. No. 14/685,526.
Notice of Allowance dated May 1, 2018 issued in U.S. Appl. No. 14/990,724.
U.S. Notice of Allowance, dated Apr. 12, 2018, issued in U.S. Appl. No. 14/936,328.
U.S. Final Office Action dated May 11, 2018 issued in U.S. Appl. No. 15/004,593.
Chinese Second Office Action dated Feb. 24, 2018 issued in Application No. CN 201510837221.9.
Chinese First Office Action dated Jan. 29, 2018, issued in Application No. CN 201610539196.0.
Chinese First Office Action dated Jun. 21, 2018, issued in Application No. CN 201610818924.1.
Merriam-Webster Dictionary, Definition of "Integrate" [Downloaded on Aug. 28, 2017 at https://www.merriam-webster.com/dictionary/integrate], 12pp.
U.S. Appl. No. 15/984,211, filed May 18, 2018, Feng et al.
Chinese Third Office Action dated Aug. 28, 2018 issued in Application No. CN 201510837221.9.
Chinese Second Office Action dated Oct. 9, 2018, issued in Application No. CN 201610539196.0.
Third Office Action dated Jan. 18, 2019, issued in Application No. CN 201610539196.0.
Chinese First Office Action dated Sep. 12, 2018 issued in Application No. CN 201710346886.9.
Korean First Office Action [Notice of Reason for Refusal] dated Jan. 14, 2019 issued in Application No. KR 10-2012-0089264.
Taiwanese Second Office Action dated Feb. 18, 2019 issued in Application No. TW 107117041.

* cited by examiner

LIPSEALS AND CONTACT ELEMENTS FOR SEMICONDUCTOR ELECTROPLATING APPARATUSES

CROSS-REFERENCE TO RELATED APPLICATIONS

This application is a divisional of and claims priority to U.S. patent application Ser. No. 13/584,343, filed Aug. 13, 2012, which claims the benefit of U.S. Provisional Patent Application No. 61/523,800, filed Aug. 15, 2011 and titled "LIPSEALS AND CONTACT ELEMENTS FOR SEMICONDUCTOR ELECTROPLATING APPARATUSES," all of which are hereby incorporated by reference herein in their entireties for all purposes.

TECHNICAL FIELD

This invention relates to the formation of damascene interconnects for integrated circuits, and electroplating apparatuses which are used during integrated circuit fabrication.

BACKGROUND

Electroplating is a common technique used in integrated circuit (IC) fabrication to deposit one or more layers of conductive metal. In some fabrication processes it is used to deposit single or multiple levels of copper interconnects between various substrate features. An apparatus for electroplating typically includes an electroplating cell having a pool/bath of electrolyte and a clamshell designed to hold a semiconductor substrate during electroplating.

During operation of the electroplating apparatus, a semiconductor substrate is submerged into the electrolyte pool such that one surface of the substrate is exposed to electrolyte. One or more electrical contacts established with the substrate surface are employed to drive an electrical current through the electroplating cell and deposit metal onto the substrate surface from metal ions available in the electrolyte. Typically, the electrical contact elements are used to form an electrical connection between the substrate and a bus bar acting as a current source. However, in some configurations, a conductive seed layer on the substrate contacted by the electrical connections may become thinner towards the edge of the substrate, making it more difficult to establish an optimal electrical connection with the substrate.

Another issue arising in electroplating is the potentially corrosive properties of the electroplating solution. Therefore, in many electroplating apparatus a lipseal is used at the interface of the clamshell and substrate for the purpose of preventing leakage of electrolyte and its contact with elements of the electroplating apparatus other than the inside of the electroplating cell and the side of the substrate designated for electroplating.

SUMMARY OF THE INVENTION

Disclosed herein are lipseal assemblies for use in an electroplating clamshell for engaging and supplying electrical current to a semiconductor substrate during electroplating. In some embodiments, a lipseal assembly may include an elastomeric lipseal for engaging the semiconductor substrate and one or more contact elements for supplying electrical current to the semiconductor substrate during electroplating. In some embodiments, upon engagement, the elastomeric lipseal substantially excludes plating solution from a peripheral region of the semiconductor substrate.

In some embodiments, the one or more contact elements are structurally integrated with the elastomeric lipseal and include a first exposed portion which contacts the peripheral region of the substrate upon engagement of the lipseal with the substrate. In some embodiments, the one or more contact elements may further include a second exposed portion for making an electrical connection with an electrical current source. In certain such embodiments, the current source may be a bus bar of the electroplating clamshell. In some embodiments, the one or more contact elements may further include a third exposed portion connecting the first and second exposed portions. In certain such embodiments, the third exposed portion may be structurally integrated on a surface of the elastomeric lipseal.

In some embodiments, the one or more contact elements may include an unexposed portion connecting the first and second exposed portions, and the unexposed portion may be structurally integrated underneath a surface of the elastomeric lipseal. In certain such embodiments, the elastomeric lipseal is molded over the unexposed portion.

In some embodiments, the elastomeric lipseal may include a first inner diameter defining a substantially circular perimeter for excluding a plating solution from a peripheral region, and the first exposed portion of the one or more contact elements may define a second inner diameter that is larger than the first inner diameter. In certain such embodiments, the magnitude of the difference between the first inner diameter and the second inner diameter is about or less than 0.5 mm. In certain such embodiments, the magnitude of the difference between the first inner diameter and the second inner diameter is about or less than 0.3 mm.

In some embodiments, a lipseal assembly may include one or more flexible contact elements for supplying electrical current to the semiconductor substrate during electroplating. In certain such embodiments, at least a portion of the one or more flexible contact elements may be conformally positioned on an upper surface of the elastomeric lipseal and, upon engagement with the semiconductor substrate, the flexible contact elements may be configured to flex and form a conformal contact surface that interfaces with the semiconductor substrate. In certain such embodiments, the conformal contact surface interfaces with a bevel edge of the semiconductor substrate.

In some embodiments, the one or more flexible contact elements may have a portion which is not configured to contact the substrate when the substrate is engaged by the lipseal assembly. In certain such embodiments, the non-contacting portion comprises a non-conformable material. In some embodiments, the conformal contact surface forms a continuous interface with the semiconductor substrate, whereas in some embodiments, the conformal contact surface forms a non-continuous interface with the semiconductor substrate having gaps. In certain such later embodiments, the one or more flexible contact elements may include multiple wire tips or a wire mesh disposed on the surface of the elastomeric lipseal. In some embodiments, the one or more flexible contact elements conformally positioned on the upper surface of the elastomeric lipseal include conductive deposits formed using one or more techniques selected from chemical vapor deposition, physical vapor deposition, and electroplating. In some embodiments, the one or more flexible contact elements conformally positioned on the upper surface of the elastomeric lipseal may include an electrically conductive elastomeric material.

Also disclosed herein are elastomeric lipseals for use in an electroplating clamshell for supporting, aligning, and sealing a semiconductor substrate in the electroplating clamshell. In some embodiments, the lipseal includes a flexible elastomeric support edge and a flexible elastomeric upper portion located above the flexible elastomeric support edge. In some embodiments, the flexible elastomeric support edge has a sealing protrusion configured to support and seal the semiconductor substrate. In certain such embodiments, upon sealing the substrate, the sealing protrusion defines a perimeter for excluding plating solution. In some embodiments, the flexible elastomeric upper portion includes a top surface configured to be compressed, and an inner side surface located outward relative to the sealing protrusion. In certain such embodiments, the inner side surface may be configured to move inward and align the semiconductor substrate upon compression of the top surface, and in some embodiments, configured to move inward by about or at least 0.2 mm upon compression of the top surface. In some embodiments, when the top surface is not compressed, the inner side surface is located sufficiently outward to allow the semiconductor substrate to be lowered through the flexible elastomeric upper portion and placed onto the sealing protrusion without contacting the upper portion, but wherein upon placement of the semiconductor substrate on the sealing protrusion and compression of the top surface, the inner side surface contacts and pushes on the semiconductor substrate aligning the semiconductor substrate in the electroplating clamshell.

Also disclosed herein are methods of aligning and sealing a semiconductor substrate in an electroplating clamshell having an elastomeric lipseal. In some embodiments, the methods include opening the clamshell, providing a substrate to the clamshell, lowering the substrate through an upper portion of the lipseal and onto a sealing protrusion of the lipseal, compressing a top surface of the upper portion of the lipseal to align the substrate, and pressing on the substrate to form a seal between the sealing protrusion and the substrate. In some embodiments, compressing the top surface of the upper portion of the lipseal causes an inner side surface of the upper portion of the lipseal to push on the substrate aligning it in the clamshell. In some embodiments, compressing the top surface to align the substrate includes pressing on the top surface with a first surface of the cone of the clamshell, and pressing on the substrate to form a seal includes pressing on the substrate with a second surface of the cone of the clamshell.

In some embodiments, compressing the top surface to align the substrate includes pushing on the top surface with a first pressing component of the clamshell, and pressing on the substrate to form a seal includes pressing on the substrate with a second pressing component of the clamshell. In certain such embodiments, the second pressing component may be independently movable with respect to the first pressing component. In certain such embodiments, compressing the top surface includes adjusting the pressing force exerted by the first pressing component based upon the diameter of the semiconductor substrate.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with specific embodiments, it will be understood that these embodiments are not intended to be limiting.

Figure 1:
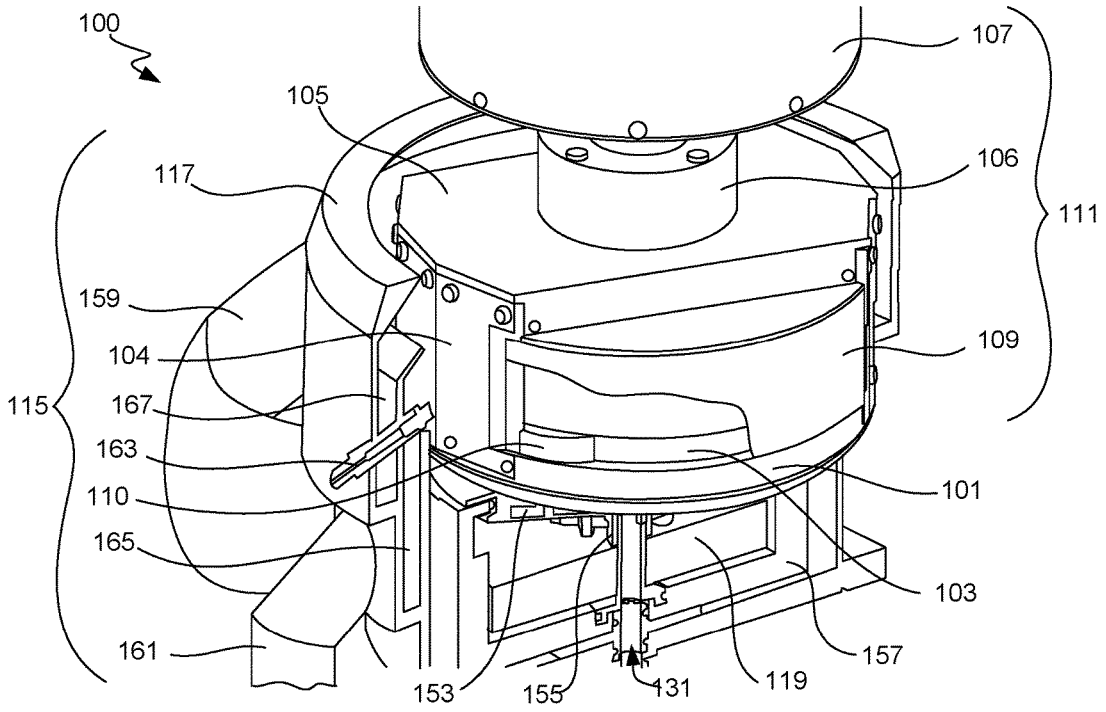
FIG. 1 is a perspective view of a wafer holding and positioning apparatus for electrochemically treating semiconductor wafers.

An exemplary electroplating apparatus is presented in FIG. 1 in order to provide some context for the various lipseal and contact element embodiments disclosed herein. Specifically, FIG. 1 presents a perspective view of a wafer holding and positioning apparatus 100 for electrochemically treating semiconductor wafers. The apparatus 100 includes wafer-engaging components, which are sometimes referred to as "clamshell components," or a "clamshell assembly," or just as a "clamshell." The clamshell assembly comprises a cup 101 and a cone 103. As will be shown in subsequent figures, the cup 101 holds a wafer and the cone 103 clamps the wafer securely in the cup. Other cup and cone designs beyond those specifically depicted here can be used. A common feature is that a cup that has an interior region in which the wafer resides and a cone that presses the wafer against the cup to hold it in place.

In the depicted embodiment, the clamshell assembly (which includes the cup 101 and the cone 103) is supported by struts 104, which are connected to a top plate 105. This assembly (101, 103, 104, and 105) is driven by a motor 107 via a spindle 106 connected to the top plate 105. The motor 107 is attached to a mounting bracket (not shown). The spindle 106 transmits torque (from the motor 107) to the clamshell assembly causing rotation of a wafer (not shown in this figure) held therein during plating. An air cylinder (not shown) within the spindle 106 also provides a vertical force for engaging the cup 101 with the cone 103. When the clamshell is disengaged (not shown), a robot with an end effector arm can insert a wafer in between the cup 101 and the cone 103. After a wafer is inserted, the cone 103 is engaged with the cup 101, which immobilizes the wafer within apparatus 100 leaving a working surface on one side of the wafer (but not the other) exposed for contact with the electrolyte solution.

In certain embodiments, the clamshell assembly includes a spray skirt 109 that protects the cone 103 from splashing electrolyte. In the depicted embodiment, the spray skirt 109 includes a vertical circumferential sleeve and a circular cap portion. A spacing member 110 maintains separation between the spray skirt 109 and the cone 103.

For the purposes of this discussion, the assembly including components 101-110 is collectively referred to as a "wafer holder" (or "substrate holder") 111. Note however, that the concept of a "wafer holder"/"substrate holder" extends generally to various combinations and sub-combinations of components that engage a wafer/substrate and allow its movement and positioning.

A tilting assembly (not shown) may be connected to the wafer holder to permit angled immersion (as opposed to flat horizontal immersion) of the wafer into a plating solution. A drive mechanism and arrangement of plates and pivot joints are used in some embodiments to move wafer the holder 111 along an arced path (not shown) and, as a result, tilt the proximal end of wafer holder 111 (i.e., the cup and cone assembly).

Further, the entire wafer holder 111 is lifted vertically either up or down to immerse the proximal end of wafer holder into a plating solution via an actuator (not shown). Thus, a two-component positioning mechanism provides both vertical movement along a trajectory perpendicular to an electrolyte surface and a tilting movement allowing deviation from a horizontal orientation (i.e., parallel to the electrolyte surface) for the wafer (angled-wafer immersion capability).

Note that the wafer holder 111 is used with a plating cell 115 having a plating chamber 117 which houses an anode chamber 157 and a plating solution. The chamber 157 holds an anode 119 (e.g., a copper anode) and may include membranes or other separators designed to maintain different electrolyte chemistries in the anode compartment and a cathode compartment. In the depicted embodiment, a diffuser 153 is employed for directing electrolyte upward toward the rotating wafer in a uniform front. In certain embodiments, the flow diffuser is a high resistance virtual anode (HRVA) plate, which is made of a solid piece of insulating material (e.g. plastic), having a large number (e.g. 4,000-15,000) of one dimensional small holes (0.01 to 0.050 inch in diameter) and connected to the cathode chamber above the plate. The total cross-section area of the holes is less than about 5 percent of the total projected area, and, therefore, introduces substantial flow resistance in the plating cell helping to improve the plating uniformity of the system. Additional description of a high resistance virtual anode plate and a corresponding apparatus for electrochemically treating semiconductor wafers is provided in U.S. patent application Ser. No. 12/291,356, filed on Nov. 7, 2008, which is hereby incorporated by reference herein in its entirety for all purposes. The plating cell may also include a separate membrane for controlling and creating separate electrolyte flow patterns. In another embodiment, a membrane is employed to define an anode chamber, which contains electrolyte that is substantially free of suppressors, accelerators, or other organic plating additives.

The plating cell 115 may also include plumbing or plumbing contacts for circulating electrolyte through the plating cell—and against the work piece being plated. For example, the plating cell 115 includes an electrolyte inlet tube 131 that extends vertically into the center of anode chamber 157 through a hole in the center of anode 119. In other embodiments, the cell includes an electrolyte inlet manifold that introduces fluid into the cathode chamber below the diffuser/HRVA plate at the peripheral wall of the chamber (not shown). In some cases, the inlet tube 131 includes outlet nozzles on both sides (the anode side and the cathode side) of the membrane 153. This arrangement delivers electrolyte to both the anode chamber and the cathode chamber. In other embodiments, the anode and cathode chamber are separated by a flow resistant membrane 153, and each chamber has a separate flow cycle of separated electrolyte. As shown in the embodiment of FIG. 1, an inlet nozzle 155 provides electrolyte to the anode-side of membrane 153.

In addition, plating cell 115 includes a rinse drain line 159 and a plating solution return line 161, each connected directly to the plating chamber 117. Also, a rinse nozzle 163 delivers deionized rinse water to clean the wafer and/or cup during normal operation. Plating solution normally fills much of the chamber 117. To mitigate splashing and generation of bubbles, the chamber 117 includes an inner weir 165 for plating solution return and an outer weir 167 for rinse water return. In the depicted embodiment, these weirs are circumferential vertical slots in the wall of the plating chamber 117.

As stated above, an electroplating clamshell typically includes a lipseal and one or more contact elements to provide sealing and electrical connection functions. A lipseal may be made from an elastomeric material. The lipseal forms a seal with the surface of the semiconductor substrate and excludes the electrolyte from a peripheral region of the substrate. No deposition occurs in this peripheral region and it is not used for forming IC devices, i.e., the peripheral region is not a part of the working surface. Sometimes, this region is also referred to as an edge exclusion area because the electrolyte is excluded from the area. The peripheral region is used for supporting and sealing the substrate during processing, as well as for making electrical connection with the contact elements. Since it is generally desirable to increase the working surface, the peripheral region needs to be as small as possible while maintaining the functions described above. In certain embodiments, the peripheral region is between about 0.5 millimeters and 3 millimeters from the edge of the substrate.

Figure 2:
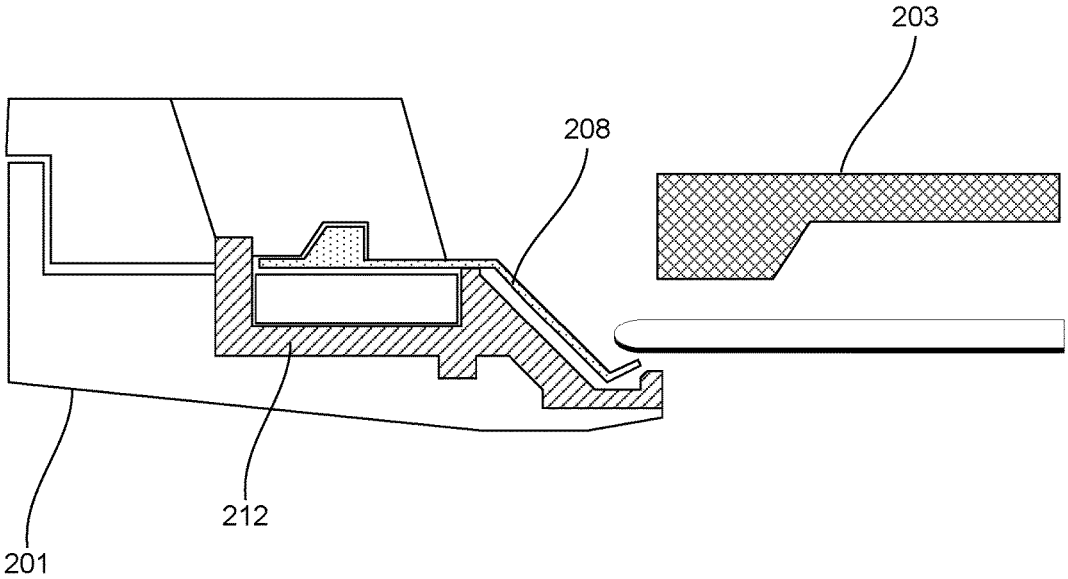
FIG. 2 is a cross-sectional schematic of a clamshell assembly having contact rings made with multiple flexible fingers.

During installation, the lipseal and contact elements are assembled together with other components of the clamshell. One having ordinary skilled in the art would appreciated the difficulty of this operation, particularly, when the peripheral region is small. An overall opening provided by this clamshell is comparable to the size of the substrate (e.g., an opening for accommodating 200 mm wafers, 300 mm wafers, 450 mm wafers, etc.). Furthermore, substrates have their own size tolerances (e.g., +/−0.2 millimeters for a typical 300 mm wafer according to the SEMI specification). A particularly difficult task is alignment of the elastomeric lipseal and contact elements, since both are made from relatively flexible materials. These two components need to have very precise relative location. When a sealing edge of the lipseal and contact elements are positioned too far away from each other, insufficient or no electrical connection may be formed between the contacts and substrate during operation of the clamshell. At the same time, when the sealing edge is positioned too close to the contacts, the contacts may interfere with the seal and cause leakage into the peripheral region. For example, conventional contact rings are often made with multiple flexible "fingers" that are pressed in a spring-like action onto the substrate to establish an electrical connection as shown in the clamshell assembly of FIG. 2

(note cup 201, cone 203, and lipseal 212). Not only are these flexible fingers 208 very difficult to align with respect to the lipseal 212, they are also easily damaged during installation and difficult to clean if and when electrolyte gets into the periphery region.

Lipseal Assemblies Having Integrated Contact Elements

Provided herein are novel lipseal assemblies having contact elements integrated into elastomeric lipseals. Instead of installing and aligning two separate sealing and electrical components (e.g., a lipseal and a contact ring) in the field, the two components are aligned and integrated during fabrication of the assembly. This alignment is maintained during installation as well as during operation of the clamshell. As such, the alignment needs to be set and inspected only once, i.e., during fabrication of the assembly.

Figure 3A:
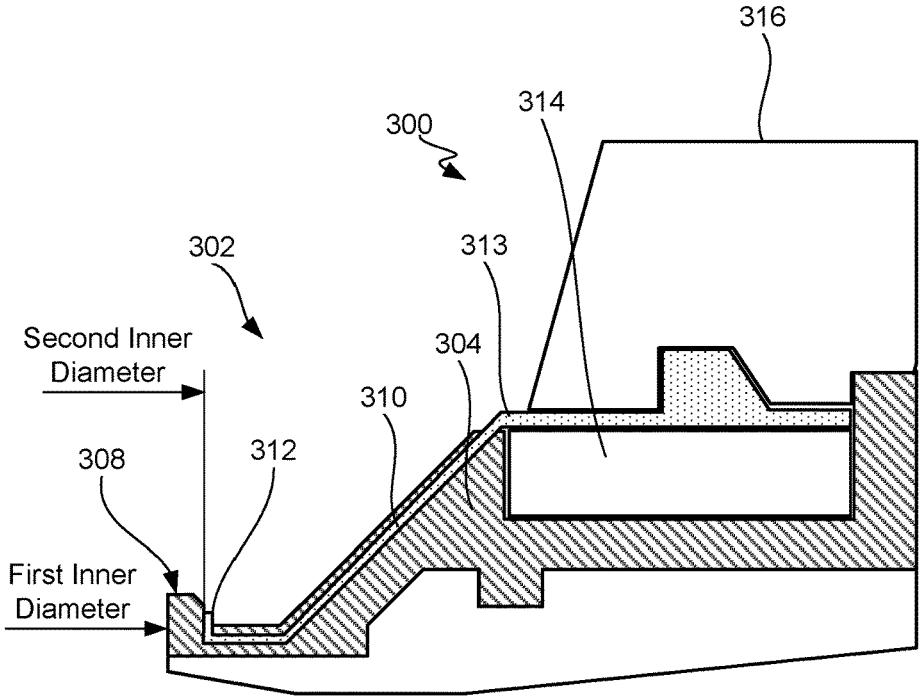
FIG. 3A is a cross-sectional schematic of a clamshell assembly having a lipseal assembly with integrated contact elements.

FIG. 3A is a schematic representation of a portion of an clamshell 300 having a lipseal assembly 302, in accordance with certain embodiments. Lipseal assembly 302 includes an elastomeric lipseal 304 for engaging the semiconductor substrate (not shown). Lipseal 304 forms a seal with the substrate and excludes a plating solution from a peripheral region of the semiconductor substrate as described in other parts of this document. Lipseal 304 may include protrusion 308 extending upwards and towards the substrate. The protrusion may be compressed and to certain degree deformed to establish the seal. Lipseal 304 has an inner diameter defining a perimeter for excluding the plating solution from the peripheral region.

Lipseal assembly 302 also includes one or more contact elements 310 structurally integrated into lipseal 304. As stated above, contact element 310 is used for supplying an electrical current to the semiconductor substrate during electroplating. Contact element 310 includes an exposed portion 312 defining a second inner diameter that is larger than the first inner diameter of lipseal 304 in order to prevent interference with the sealing properties of lipseal assembly 302. Contact element 310 generally includes another exposed portion 313 for making an electrical connection with a source of electrical current such as a bus bar 316 of the electroplating clamshell. However, other connection schemes are also possible. For example, contact element 310 may be interconnected with distribution bus 314, which may be connected to bus bar 316.

As stated above, integration of one or more contact elements 310 into lipseal 304 is performed during fabrication of lipseal assembly 302 and is preserved during installation and operation of the assembly. This integration may be performed in a variety of ways. For example, an elastomeric material may be molded over contact element 310. Other elements, such as current distribution bus 314, may be also integrated into the assembly to improve rigidity, conductivity, and other functionalities of assembly 302.

The lipseal assembly 302 illustrated in FIG. 3A has a contact element 310 with a middle unexposed portion located between the two exposed portions 312 and 313 and connecting the two exposed portions. This unexposed portion extends through the body of the elastomeric lipseal 304 and is fully enclosed by the elastomeric lipseal 304 being structurally integrated underneath a surface of the elastomeric lipseal. This type of lipseal assembly 302 may be formed, for example, by molding the elastomeric lipseal 304 over the unexposed portion of contact element 310. Such a contact element may be particularly easy to clean since only small portions of contact element 310 extend to the surface of lipseal assembly 302 and are exposed.

Figure 3B:
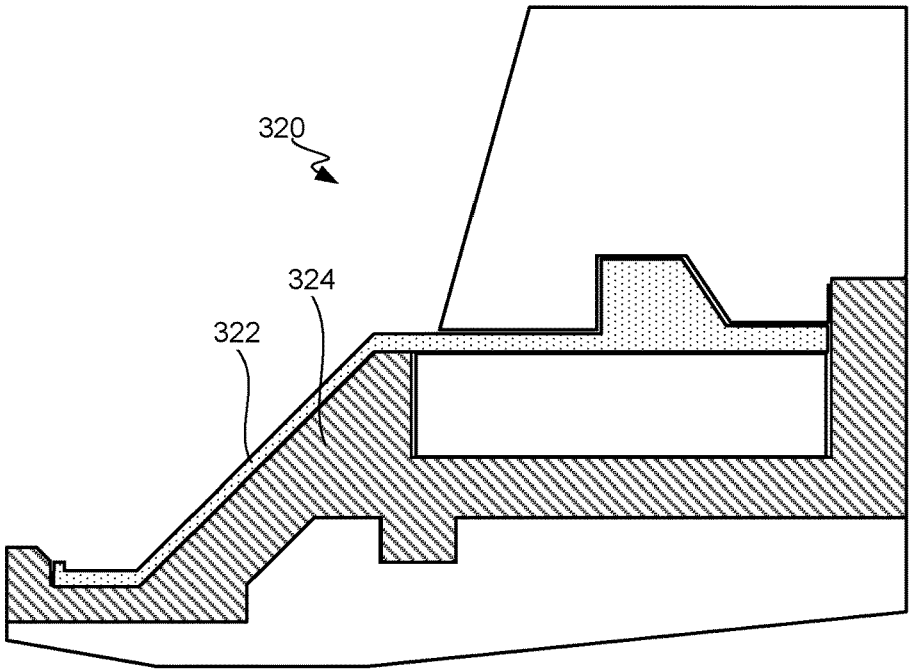
FIG. 3B is a cross-sectional schematic of another clamshell assembly having a different lipseal assembly with integrated contact elements.

FIG. 3B illustrates another embodiment where contact element 322 extends on the surface of elastomeric lipseal 304 and does not have a middle region enclosed by the lipseal assembly. In some embodiments, the middle region could be viewed as a third exposed portion of the contact element which is structurally integrated on a surface of the elastomeric lipseal, and is located between the first two exposed portions of the contact element 312 and 313, connecting these two portions. This embodiment may be assembled, for example, by pressing contact element 322 into the surface, or by molding it into the surface, or by gluing it to the surface, or by otherwise attaching it to the surface. Regardless of how the contact elements are integrated into the elastomeric lipseal, a point or surface of the contact element making an electrical connection to the substrate will preferentially maintain its alignment with respect to the point or surface of the lipseal making a seal with the substrate. Other portions of the contact element and lipseal may be movable with respect to each other. For example, an exposed portion of the contact element that makes an electrical connection to the bus bar may move with respect to the lipseal.

Returning to FIG. 3A, the first inner diameter defines the peripheral region while the second inner diameter defines overlap between the contact element and substrate. In certain embodiments, the magnitude of the difference between the first and second inner diameters is about or less than 0.5 millimeters (mm), which means that exposed portion 312 of contact element 310 is separated by about or less than 0.25 mm from the electrolyte solution. This small separation allows having a relatively small peripheral region while maintaining a sufficient electrical connection to the substrate. In certain such embodiments, the magnitude of the difference between the first and second inner diameters is about or less than 0.4 mm, or about or less than 0.3 mm, or about or less than 0.2 mm, or about or less than 0.1 mm. In other embodiments, the magnitude of the difference between these diameters may be about or less than 0.6 mm, or about or less than 0.7 mm, or about or less than 1 mm. In certain embodiments, the contact elements are configured to conduct at least about 30 Amperes or, more specifically, at least about 60 Amperes. A contact element may include multiple fingers such that each contacting tip of these fingers is fixed with respect to the edge of the lipseal. In the same or other embodiments, an exposed portion of the one or more contact elements includes multiple contact points. These contacts points may extend away from the surface of the elastomeric lipseal. In other embodiments, an exposed portion of the one or more contact elements includes a continuous surface.

Lipseal Assemblies Having Flexible Contact Elements which Form a Conformal Contact Surface Electrical connection to the substrate may be significantly improved by increasing the contact surface between the contact elements and the substrate during the sealing of the substrate in the clamshell assembly and the subsequent electroplating. Conventional contact elements (e.g., "fingers" shown in FIG. 2) are designed to make only a "point contact" with the substrate that has a relatively small contact area. When a tip of the contact finger touches the substrate, the finger bends to provide a force against the substrate. While this force may help to decrease the contact resistance somewhat, there oftentimes still remains enough contact resistance to create problems during electroplating. Furthermore, the contact fingers may become damaged over time by many repetitions of the bending action.

Described herein are lipseal assemblies having one or more flexible contact elements conformally positioned on an upper surface of an elastomeric lipseal. These contact elements are configured to flex upon engagement with semiconductor substrate and form a conformal contact surface that interfaces with the semiconductor substrate when the substrate is supported, engaged, and sealed by the lipseal assembly. The conformal contact surface is created when the substrate is pressed against the lipseal in a manner similar to the manner in which the seal is created between the substrate and the lipseal. However, the sealing interface surfaces should generally be distinguished from the conformal contact surface even though the two surfaces may be formed adjacent to one another.

Figure 4A:
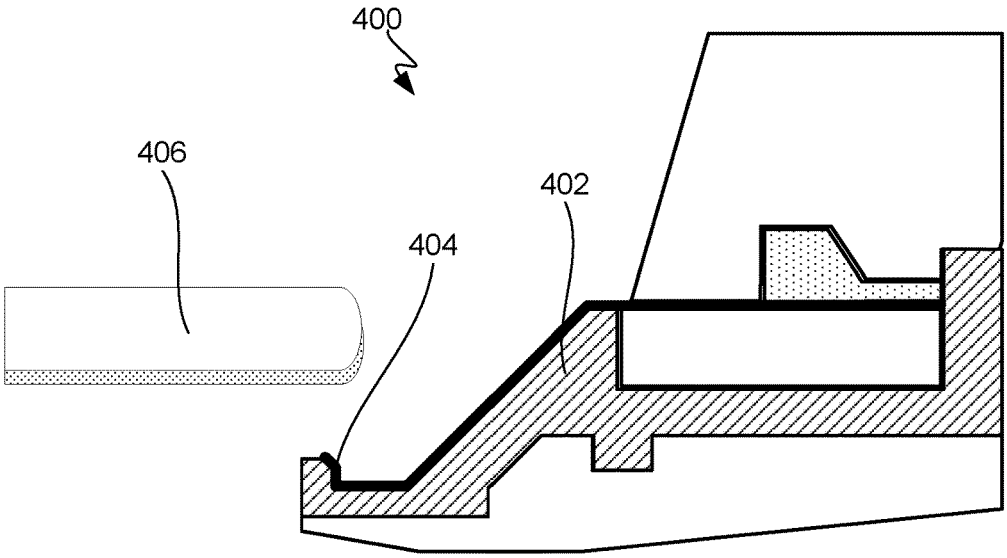
FIG. 4A is a cross-sectional schematic of a lipseal assembly having flexible contact elements.
Figure 4B:
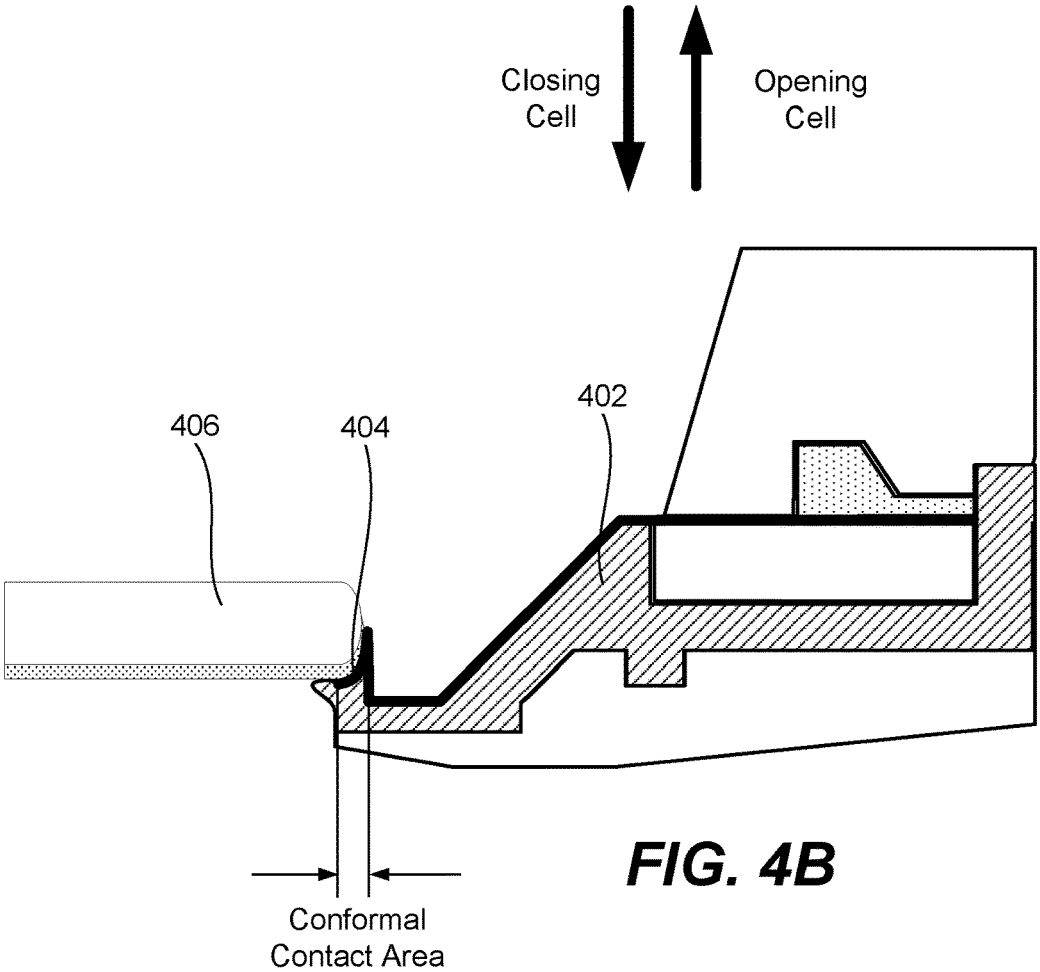
FIG. 4B is a cross-sectional schematic of the lipseal assembly of FIG. 4A shown forming a conformal contact surface interfacing with a semiconductor substrate.

FIG. 4A illustrates a lipseal assembly 400 having a flexible contact element 404 positioned on the upper surface of elastomeric lipseal 402 prior to positioning and sealing the substrate 406 onto lipseal 402, in accordance with certain embodiments. FIG. 4B illustrates the same lipseal assembly 400 after the substrate 406 has been positioned and sealed with the lipseal 402, in accordance with certain embodiments. Specifically, flexible contact element 404 is shown to flex and form a conformal contact surface at the interface with the substrate 406 when the substrate is held/engaged by the lipseal assembly. The electrical interface between flexible contact element 404 and substrate 406 may extend over the (flat) front surface of the substrate and/or the beveled edge surface of the substrate. Overall, a larger contact interface area is formed by providing a conformal contact surface of flexible contact element 404 at the interface with the substrate 406.

While the conformal nature of the flexible contact element 404 is important at the interface with the substrate, the remaining portion of flexible contact element 404 may also be conformal with respect to lipseal 402. For example, flexible contact element 404 may conformally extend along the surface of lipseal. In other embodiments, the remaining portion of the flexible contact element 404 may be made from other (e.g., non-conformal) materials and/or have a different (e.g., non-conformal) configuration. Therefore, in some embodiments, the one or more flexible contact elements may have a portion which is not configured to contact the substrate when the substrate is engaged by the lipseal assembly, and this non-contacting portion may comprise a conformable material, or it may comprise a non-conformable material.

Furthermore, it should be noted that although a conformal contact surface may form a continuous interface between the flexible contact element 404 and semiconductor substrate 406, it is not required to form a continuous interface. For example, in some embodiments, a conformal contact surface has gaps forming a non-continuous interface with the semiconductor substrate. Specifically, a non-continuous conformal contact surface may be formed from a flexible contact element 404 which comprises many multiple wire tips and/or a wire mesh disposed on the surface of the elastomeric lipseal. Even if non-continuous, the conformal contact surface follows the shape of the lipseal while the lipseal is being deformed during the closing of the clamshell.

Flexible contact element 404 may be attached to the upper surface of the elastomeric lipseal. For example, flexible contact element 404 may be pressed, glued, molded, or otherwise attached to the surface, as described above with reference to FIG. 3A and FIG. 3B (albeit not in the specific context of flexible contact elements which form a conformal contact surface). In other embodiments, flexible contact element 404 may be positioned over the upper surface of the elastomeric lipseal without providing any specific bonding features between the two. In either case, conformality of flexible contact element 404 is ensured by the force exerted by the semiconductor substrate when the clamshell is closed. Furthermore, although the portion of the flexible contact element 404 which interfaces with the substrate 406 (forming a conformal contact surface) is an exposed surface, other portions of the flexible contact element 404 may be unexposed, for example, being integrated underneath a surface of the elastomeric lipseal, in a manner somewhat similar to the integrated, albeit non-conformal, lipseal assembly illustrated in FIG. 3B.

In certain embodiments, a flexible contact element 404 includes a conductive layer of conductive deposits deposited on the upper surface of the elastomeric lipseal. The conductive layer of conductive deposits may be formed/deposited using chemical vapor deposition (CVD), and/or physical vapor deposition (PVD), and/or (electro)plating. In some embodiments, the flexible contact element 404 may be made of an electrically conductive elastomeric material.

Substrate Aligning Lipseals

As previously explained, the peripheral region of the substrate from which plating solution is excluded needs to be small, which requires careful and precise alignment of the semiconductor substrate prior to closing and sealing the clamshell. Misalignment may cause leaking on the one hand, and/or unnecessary covering/blocking of substrate working areas on the other. Tight substrate diameter tolerances may cause additional difficulties during alignment. Some alignment may be provide by the transfer mechanism (e.g., depending on the accuracy of a robot handoff mechanism), and by using alignment features such as snubbers positioned in the side walls of the clamshell cup. However, the transfer mechanism needs to be precisely installed and aligned during installation with respect to the cup (i.e., "taught" about relative position of other components) in order to provide precise and repetitive positioning of the substrates. This robot teaching and alignment process is rather difficult to perform, is labor intensive, and requires highly skilled personnel. Furthermore, the snubber features are difficult to install and tend to have big tolerance stack-ups because there are many parts positioned between the lipseal and snubbers.

Figure 5A:
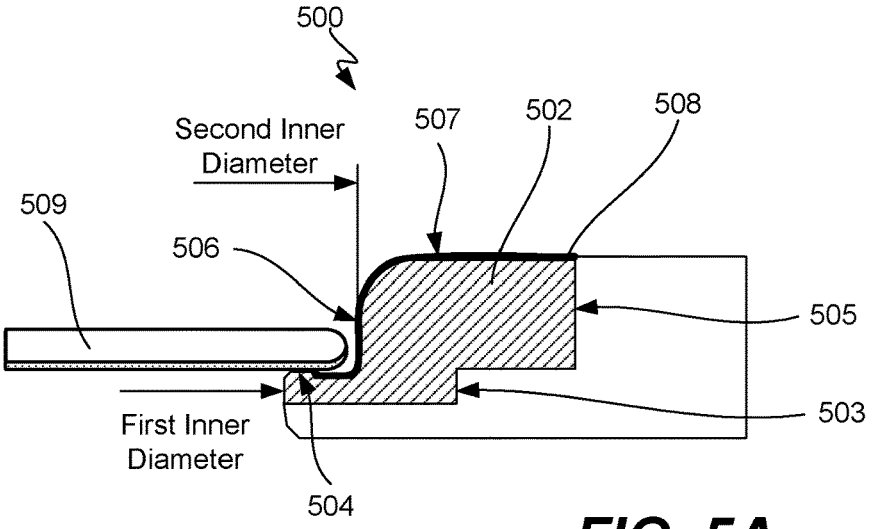
FIG. 5A is a cross-sectional schematic of a lipseal assembly configured to align a semiconductor substrate within a clamshell assembly.

Accordingly, disclosed herein are lipseals which are not only used for supporting and sealing the substrate in the clamshell but also for aligning the substrate in the clamshell prior to sealing. Various features of such lipseals will now be described with reference to FIGS. 5A through 5C. Specifically, FIG. 5A is a cross-sectional schematic representation of a clamshell portion 500 having a lipseal 502 supporting a substrate 509 prior to compressing a portion of lipseal 502, in accordance with certain embodiments. Lipseal 502 includes a flexible elastomeric support edge 503 comprising a sealing protrusion 504. The sealing protrusion 504 is configured to engage the semiconductor substrate 509, providing support, and forming a seal. Sealing protrusion 504 defines a perimeter for excluding a plating solution, and may have a first inner diameter (see FIG. 5A) defining the exclusion perimeter. It should be noted that the perimeter and/or first inner diameter may slightly change while sealing the substrate against the elastomeric lipseal due to deformation of the sealing protrusion 504.

Lipseal 502 also includes a flexible elastomeric upper portion 505 located above the flexible elastomeric support edge 503. The flexible elastomeric upper portion 505 may include a top surface 507 configured to be compressed, and also an inner side surface 506. The inner side surface 506 may be located outward relative to the sealing protrusion 504 (meaning that the inner side surface 506 is located further from the center of a semiconductor substrate being held by the elastomeric lipseal than the sealing protrusion 504), and be configured to move inward (towards the center of a semiconductor substrate being held) when the top surface 507 is compressed by another component of the electroplating clamshell. In some embodiments, at least a portion of the inner side surface is configured to move inward by at least about 0.1 mm, or at least about 0.2 mm, or at least about 0.3 mm, or at least about 0.4 mm, or at least about 0.5 mm. This inward motion may cause the inner side surface 506 of the lipseal to contact the edge of a semiconductor substrate resting on the sealing protrusion 504, pushing the substrate towards the center of the lipseal and thus aligning it within the electroplating clamshell. In some embodiments, the flexible elastomeric upper portion 505 defines a second inner diameter (see FIG. 5A) which is greater than the first inner diameter (described above). When top surface 507 is not compressed, the second inner diameter is greater than the diameter of the semiconductor substrate 509, so that the semiconductor substrate 509 may be loaded into the clamshell assembly by lowering it through the flexible elastomeric upper portion 505 and placing it onto the sealing protrusion 504 of flexible elastomeric support edge 503.

Elastomeric lipseal 502 may also have an integrated or otherwise attached contact element 508. In other embodiments, contact element 508 may be a separate component. In any event, whether or not it is a separate component, if contact element 508 is provided on inner side surface 506 of lipseal 502, then contact element 508 may also be involved in the aligning of the substrate. Thus, in these examples, if present, contact element 508 is considered to be a part of inner side surface 506.

Figure 5B:
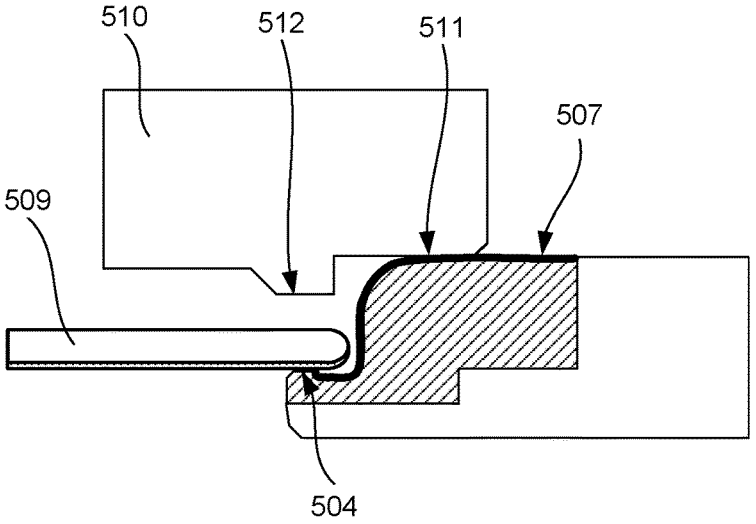
FIG. 5B is a cross-sectional schematic of the lipseal assembly of FIG. 5A with a surface of the cone of the clamshell assembly pressing on an upper surface of the lipseal assembly.

Compression of the top surface 507 of the elastomeric upper portion 505 (in order to align and seal the semiconductor substrate within the electroplating clamshell) may be accomplished in a variety of ways. For instance, top surface 507 may be compressed by a portion of the cone or some other component of the clamshell. FIG. 5B is a schematic representation of the same clamshell portion shown in FIG. 5A immediately prior to being compressed with cone 510, in accordance with certain embodiments. If cone 510 is used to press on top surface 507 of upper portion 505 in order to deform upper portion as well as to press on substrate 509 in order to seal substrate 509 against sealing protrusion 504, then cone may have two surfaces 511 and 512 offset with respect to each other in a particular way. Specifically, first surface 511 is configured to press top surface 507 of upper portion 505, while second surface 512 is configured to press on substrate 509. Substrate 509 is generally aligned prior to sealing substrate 509 against sealing protrusion 504. Therefore, first surface 511 may need to press on top surface 507 prior to second surface 512 pressing on substrate 509. As such, a gap may exist between second surface 512 and substrate 509 when first surface 511 contacts top surface 507, as shown in FIG. 5B. This gap may depend on necessary deformation of upper portion 505 to provide alignment.

In other embodiments, top surface 507 and substrate 509 are pressed by different components of the clamshell that may have independently controlled vertical positioning. This configuration may allow for independently controlling the deformation of upper portion 505 prior to pressing onto the substrate 509. For example, some substrates may have larger diameters than others. Alignment of such larger substrates may need and even require, in certain embodiments, less deformation than smaller substrates because there is a less initial gap between the larger substrates and inner side surface 506.

Figure 5C:
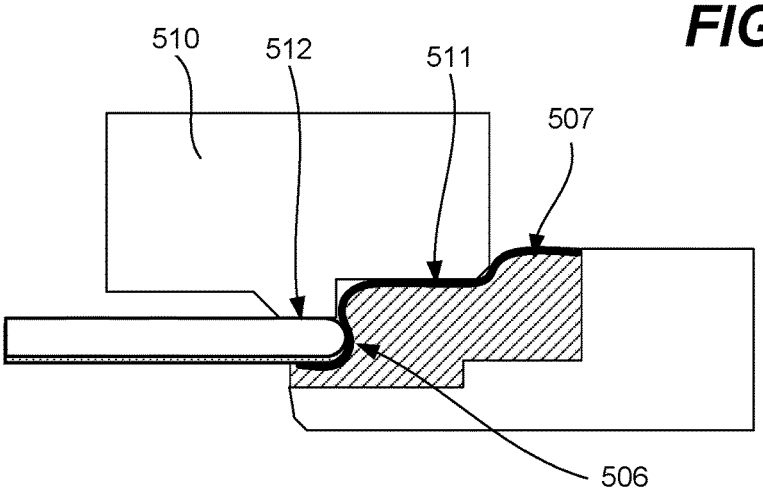
FIG. 5C is a cross-sectional schematic of the lipseal assembly of FIG. 5A and FIG. 5B with a surface of the cone of the clamshell assembly pushing on both an upper surface of the lipseal and on the semiconductor substrate.

FIG. 5C is a schematic representation of the same clamshell portion shown in FIG. 5A and FIG. 5B after the clamshell is sealed, in accordance with certain embodiments. Compression of top surface 507 of upper portion 505 by first surface 511 of cone 510 (or some other compressing components) causes deformation of upper portion 505 such that inner side surface 506 moves inwards, contacting and pushing on semiconductor substrate 509, in order to align semiconductor substrate 509 in the clamshell. While FIG. 5C illustrates a cross-section of a small portion of the clamshell, one of ordinary skill in the art would appreciate that this alignment process occurs simultaneously around the entire perimeter of substrate 509. In certain embodiments, a portion of the inner side surface 506 is configured to move by at least about 0.1 mm, or at least about 0.2 mm, or at least about 0.3 mm, or at least about 0.4 mm, or at least about 0.5 mm towards a center of the lipseal when the top surface 507 is compressed.

Methods of Aligning and Sealing a Substrate in a Clamshell

Figure 6:
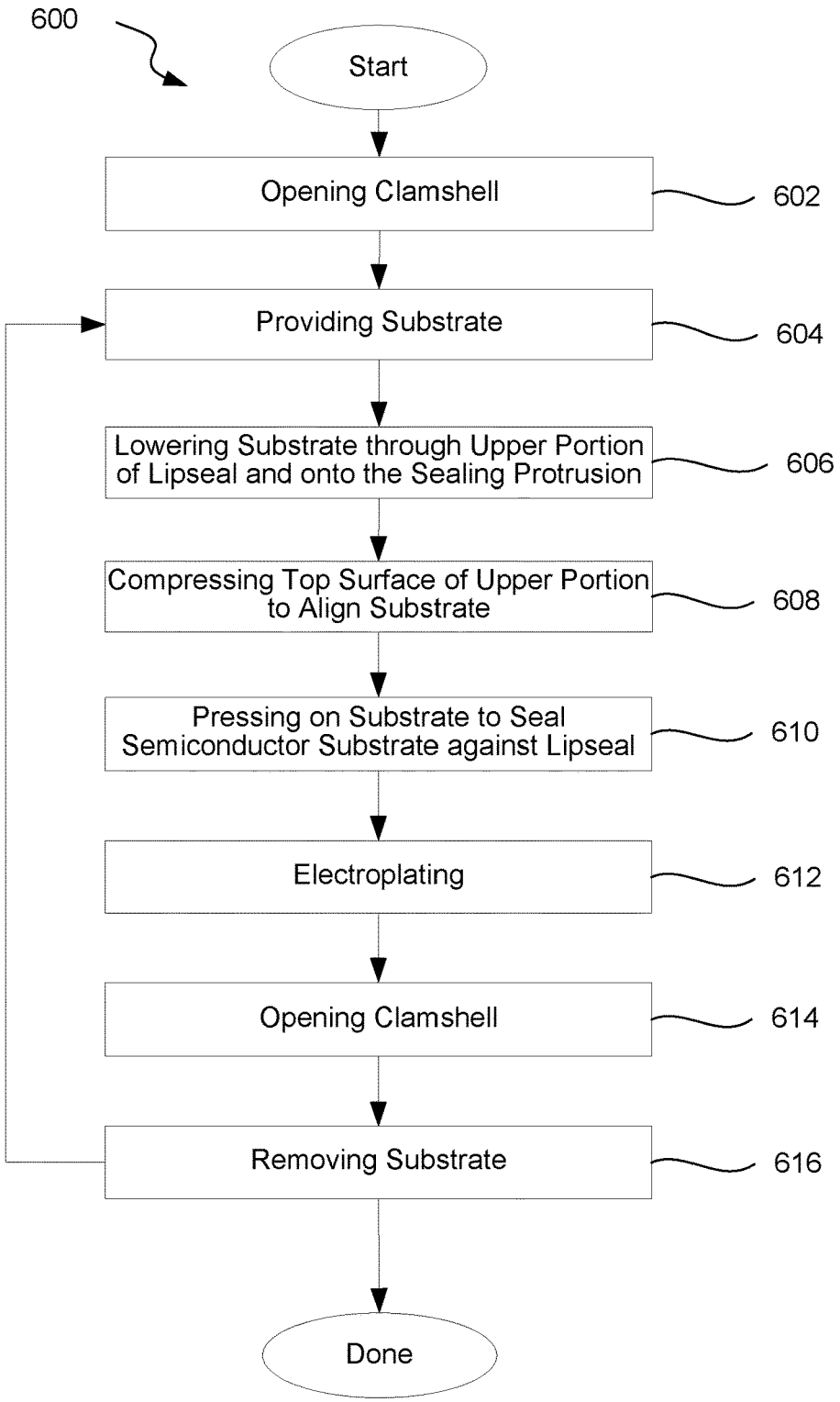
FIG. 6 is a flowchart illustrating a method of electroplating a semiconductor substrate.

Also disclosed herein are methods of aligning and sealing a semiconductor substrate in an electroplating clamshell having an elastomeric lipseal. The flowchart of FIG. 6 is illustrative of some of these methods. For instance, some embodiment methods involve opening the clamshell (block 602), providing a substrate to the electroplating clamshell (block 604), lowering the substrate through an upper portion of the lipseal and onto a sealing protrusion of the lipseal (block 606), and compressing a top surface of the upper portion of the lipseal to align the substrate (block 608). In some embodiments, compressing the top surface of the upper portion of the elastomeric lipseal during operation 608 causes an inner side surface of the upper portion to contact the semiconductor substrate and push on the substrate aligning it in the clamshell.

After aligning the semiconductor substrate during operation 608, in some embodiments, the method proceeds by pressing on the semiconductor substrate in operation 610 to form a seal between the sealing protrusion and the semiconductor substrate. In certain embodiments, compressing the top surface continues during pressing on the semiconductor substrate. For example, in certain such embodiments, compressing the top surface and pressing on the semiconductor substrate may be performed by two different surfaces of the cone of the clamshell. Thus, a first surface of the cone may press on the top surface to compress it, and a second surface of the cone may press on the substrate to form a seal with the elastomeric lipseal. In other embodiments, compressing the top surface and pressing on the semiconductor substrate are performed independently by two different components of the clamshell. These two pressing components of the clamshell are typically independently movable with respect to one another, thus allowing compression of the top surface to be halted once the substrate is pressed upon and sealed against the lipseal by the other pressing component. Furthermore, the compression level of the top surface may be adjusted based upon the diameter of the semiconductor substrate by independently altering the pressing force exerted upon it by its associated pressing component.

These operations may be part of a larger electroplating process, which is also depicted in the flowchart of FIG. 6 and briefly described below.

Initially, the lipseal and contact area of the clamshell may be clean and dry. The clamshell is opened (block 602) and the substrate is loaded into the clamshell. In certain embodiments, the contact tips sit slightly above the plane of the sealing lip and the substrate is supported, in this case, by the array of contact tips around the substrate periphery. The clamshell is then closed and sealed by moving the cone downward. During this closure operation, the electrical contacts and seals are established according to various embodiments described above. Further, the bottom corners of the contacts may be force down against the elastic lipseal base, which results in additional force between the tips and the front side of the wafer. The sealing lip may be slightly compressed to ensure the seal around the entire perimeter. In some embodiments, when the substrate is initially positioned into the cup only the sealing lip is contact with the front surface. In this example, the electrical contact between the tips and the front surface is established during compression of the sealing lip.

Once the seal and the electrical contact is established, the clamshell carrying the substrate is immersed into the plating bath and is plated in the bath while being held in the clamshell (block 612). A typical composition of a copper plating solution used in this operation includes copper ions at a concentration range of about 0.5-80 g/L, more specifically at about 5-60 g/L, and even more specifically at about 18-55 g/L and sulfuric acid at a concentration of about 0.1-400 g/L. Low-acid copper plating solutions typically contain about 5-10 g/L of sulfuric acid. Medium and high-acid solutions contain about 50-90 g/L and 150-180 g/L sulfuric acid, respectively. The concentration of chloride ions may be about 1-100 mg/L. A number of copper plating organic additives such as Enthone Viaform, Viaform NexT, Viaform Extreme (available from Enthone Corporation in West Haven, Conn.), or other accelerators, suppressors, and levelers known to those of skill in the art can be used. Examples of plating operations are described in more detail in U.S. patent application Ser. No. 11/564,222 filed on Nov. 28, 2006, which is hereby incorporated by reference in its entirety herein for all purposes, but in particular for the purpose of the describing plating operations. Once the plating is completed and an appropriate amount of material has been deposited on the front surface of the substrate, the substrate is then removed from the plating bath. The substrate and clamshell are then spun to remove most of the residual electrolyte on the clamshell surfaces which has remained there due to surface tension and adhesive forces. The clamshell is then rinsed while continued to be spun to dilute and flush as much of the entrained electrolytic fluid as possible from clamshell and substrate surfaces. The substrate is then spun with rinsing liquid turned off for some time, usually at least about 2 seconds to remove some remaining rinsate. The process may proceed by opening the clamshell (block 614) and removing the processed substrate (block 616). Operational blocks 604 through 616 may be repeated multiple times for new wafer substrates, as indicated in FIG. 6.

In certain embodiments, a system controller is used to control process conditions during sealing the clamshell and/or during processing of the substrate. The system controller will typically include one or more memory devices and one or more processors. The processor may include a CPU or computer, analog and/or digital input/output connections, stepper motor controller boards, etc. Instructions for implementing appropriate control operations are executed on the processor. These instructions may be stored on the memory devices associated with the controller or they may be provided over a network.

In certain embodiments, the system controller controls all of the activities of the processing system. The system controller executes system control software including sets of instructions for controlling the timing of the processing steps listed above and other parameters of a particular process. Other computer programs, scripts or routines stored on memory devices associated with the controller may be employed in some embodiments.

Typically, there is a user interface associated with the system controller. The user interface may include a display screen, graphical software to display process conditions, and user input devices such as pointing devices, keyboards, touch screens, microphones, etc.

The computer program code for controlling the above operations can be written in any conventional computer readable programming language: for example, assembly language, C, C++, Pascal, Fortran or others. Compiled object code or script is executed by the processor to perform the tasks identified in the program.

Signals for monitoring the processes may be provided by analog and/or digital input connections of the system controller. The signals for controlling the processes are output on the analog and digital output connections of the processing system.

The apparatuses/processes described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

Other Embodiments

Although illustrative embodiments and applications of this invention are shown and described herein, many variations and modifications are possible which remain within the concept, scope, and spirit of the invention, and these variations would become clear to those of ordinary skill in the art after perusal of this application. Accordingly, the present embodiments are to be considered as illustrative and not restrictive, and the invention is not to be limited to the details given herein, but may be modified within the scope and equivalents of the appended claims.

We claim:

1. A lipseal assembly for use in an electroplating clamshell for engaging and supplying electrical current to a semiconductor substrate during electroplating, the lipseal assembly comprising:

an elastomeric lipseal for engaging the semiconductor substrate during electroplating, wherein upon engagement the elastomeric lipseal substantially excludes plating solution from a peripheral region of the semiconductor substrate; and one or more contact elements for supplying electrical current to the semiconductor substrate during electroplating, the one or more contact elements conformally positioned on an upper surface of the elastomeric lipseal and comprising a first exposed portion which contacts the peripheral region of the substrate upon engagement of the lipseal with the substrate;

wherein an engaging portion of the elastomeric lipseal which engages the substrate during electroplating is positioned relative to the first exposed portion of the electrical contact element such that during engagement said engaging portion of the lipseal compresses against the substrate prior to the first exposed portion of the electrical contact element making electrical contact with the substrate, wherein the one or more contact elements further comprise a second exposed portion for making an electrical connection with an electrical current source and a third exposed portion connecting the first and second exposed portions, the third exposed portion conformally positioned on the upper surface of the elastomeric lipseal; and wherein the third exposed portion is pressed, glued, molded, or otherwise attached directly to a surface of the elastomeric lipseal.

2. The lipseal assembly of claim 1, wherein the current source is a bus bar of the electroplating clamshell.

3. The lipseal assembly of claim 1, wherein the engaging portion of the elastomeric lipseal includes a protrusion extending upwards and configured to be compressed by the semiconductor substrate and form a seal to substantially exclude the plating solution.

4. The lipseal assembly of claim 3, wherein the first exposed portion of the electrical contact element is aligned with the protrusion of the elastomeric lipseal.

5. The lipseal assembly of claim 1, wherein the elastomeric lipseal comprises a first inner diameter defining a substantially circular perimeter for excluding the plating solution from the peripheral region, and wherein the first exposed portion of the one or more contact elements defines a second inner diameter that is larger than the first inner diameter.

6. The lipseal assembly of claim 5, wherein the magnitude of the difference between the first inner diameter and the second inner diameter is about or less than 0.5 mm.

7. The lipseal assembly of claim 6, wherein the magnitude of the difference between the first inner diameter and the second inner diameter is about or less than 0.3 mm.

* * * * *